US005905332A

United States Patent [19]

Yun et al.

[11] Patent Number: 5,905,332

[45] Date of Patent: May 18, 1999

[54] ELECTRON GUN FOR COLOR CATHODE RAY TUBE

[75] Inventors: Neung-yong Yun, Seoul; Hak-cheol Yang, Suwon, both of Rep. of Korea

[73] Assignee: Samsung Display Devices Co., Ltd., Kyungki-Do, Rep. of Korea

[21] Appl. No.: 08/922,641

[22] Filed: Sep. 3, 1997

[51] Int. Cl.[6] ..... H01J 29/50

[52] U.S. Cl. ..... 313/414; 313/412; 313/447; 313/409

[58] Field of Search ..... 313/412, 414, 313/413, 446, 447, 452, 409

[56] References Cited

U.S. PATENT DOCUMENTS 5,491,375 2/1996 Iwasaki ..... 313/409

*Primary Examiner*—Nimeshkumar D. Patel
*Attorney, Agent, or Firm*—Leydig, Voit & Mayer

[57] ABSTRACT

An electron gun for a color cathode ray tube includes a cathode structure having three electron emitting portions in a field emission array cell. A focus electrode and a final acceleration electrode are sequentially arranged with respect to the cathode structure and form a main lens for focusing electron beams emitted from the three electron emitting portions. The eccentric distance of the electron emitting portions is shorter than the eccentric distance of the electron beam emitting holes in the focus electrode opposite the electron emitting portions. Focus characteristics and convergence characteristics are improved.

8 Claims, 5 Drawing Sheets

ELECTRON GUN FOR COLOR CATHODE RAY TUBE

BACKGROUND OF THE INVENTION

The present invention relates to an electron gun for a color cathode ray tube and, more particularly, to an electron gun for a color cathode ray tube in which a field emission array cell is employed as an electron emitting source.

A general color cathode ray tube includes a panel 10 on the inner surface of which a fluorescent film (not shown) is located, a funnel 20 sealingly coupled with the panel 10, an electron gun 30 installed in the neck portion 21 of the funnel 20, and a deflection yoke 23 around the cone portion 22.

In the cathode ray tube of the above construction, an electron beam emitted from the electron gun 30 is deflected by the deflection yoke 23, collides with the fluorescent film, and excites a fluorescent material, thus forming a picture.

FIG. 2 shows an example of an electron gun in the neck portion of the funnel for thermionic emission.

The electron gun 30 includes a cathode structure 31 including a field emission array cell having electron emitting portions 31R, 31G, and 31B spaced from each other by a predetermined distance on a substrate 31*a* for emitting electrons for making red, green, and blue fluorescent materials radiate light, and a focus and a final acceleration electrode 32 and 33 for forming an electron lens for focusing and accelerating the electron beam.

Electron beam transmitting holes 32R, 32G, and 32B and 33R, 33G, and 33B corresponding to the electron emitting portions 31R, 31G, and 31B are respectively formed in the focus electrode 32 and the final acceleration electrode 33.

In the operation of a conventional electron gun for a color cathode ray tube having the described construction, the electron beam is emitted from the electron emitting portions 31R, 31G, and 31B when a predetermined voltage is applied. The emitted electron beam is focused and accelerated by a main lens located between the focus electrode 32 and the final acceleration electrode 33 and lands on fluorescent material of the fluorescent film.

However, the conventional electron gun for a cathode ray tube has the following problems.

First, since the electron beam is emitted from the electron emitting portion including the field emission array cell at an angle of more than 20 degrees, spherical aberration is generated in a main electron lens that is larger than the aberration of an electron gun having a hot cathode in which the incidence angle is less than 5 degrees.

Second, according to the prior art, in order to focus the electron beam emitted from the electron emitting portions 31R, 31G, and 31B into a pixel, an "eccentric distance" S1, which is hereinafter defined as the distance between the electron trasmitting hole or the electron emitting portion positioned in the center of an axial direction of the electron gun and the electron beam transmitting holes or the electron emitting portions positioned on both sides thereof. The electron beam transmitting holes 32R, 32G, and 32B in the facing surfaces of the focus electrode 32 differs from "eccentric distance" S2 between the electron beam transmitting holes 33R, 33G, and 33B in the facing surface of the final acceleration electrode 33. Thus the electron beams on both sides converge on the electron beam of the central portion. At this time, since the above-mentioned convergence is performed in a state in which the electron beam is accelerated, the effect thereof is negligible.

Third, the section of the electron beam landing on the fluorescent film is distorted. Specifically, since the electron emitting portions 31R, 31G, and 31B of the cathode structure 31 are circular, the section of the electron beam focused, accelerated and passing through the main lens becomes circular. The electron beam passes through a non-uniform magnetic field formed by vertical and horizontal deflection coils and the section of the electron beam deflected toward the peripheral portion of the fluorescent film becomes elongated in the horizontal direction. When the elongated electron beam lands on the fluorescent film, a core section and a hazy section are generated in the horizontal direction and the vertical direction, respectively, thus deteriorating the sharpness of the picture.

SUMMARY OF THE INVENTION

It is an object of the present invention to provide an electron gun for a color cathode ray tube for effectively focusing an electron beam emitted from the electron gun.

To achieve the above object, there is provided an electron gun for a color cathode ray tube including a cathode structure having three electron emitting portions formed of a field emission array cell and a focus electrode and a final acceleration electrode sequentially installed from the electron emitting portions. The electron gun forms a main electron lens for focusing and accelerating the electron beam, wherein the "eccentric distance" between the three electron emitting portions is shorter than that between the electron beam transmission holes formed in the focus electrode.

To achieve the above object, there is provided an electron gun for a color cathode ray tube of the present invention, including a cathode structure having electron emitting portions formed of a field emission array for emitting an electron beam corresponding to red, blue, and green fluorescent materials and a focus electrode and a final acceleration electrode sequentially installed from the electron emitting portions for forming a main electron lens for focusing the electron beam emitted from the electron emitting portion and in which the electron beam transmitting holes are respectively formed, wherein the eccentric distance between the electron emitting portions is shorter than that between the electron beam transmitting holes formed in the focus electrode.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 3:
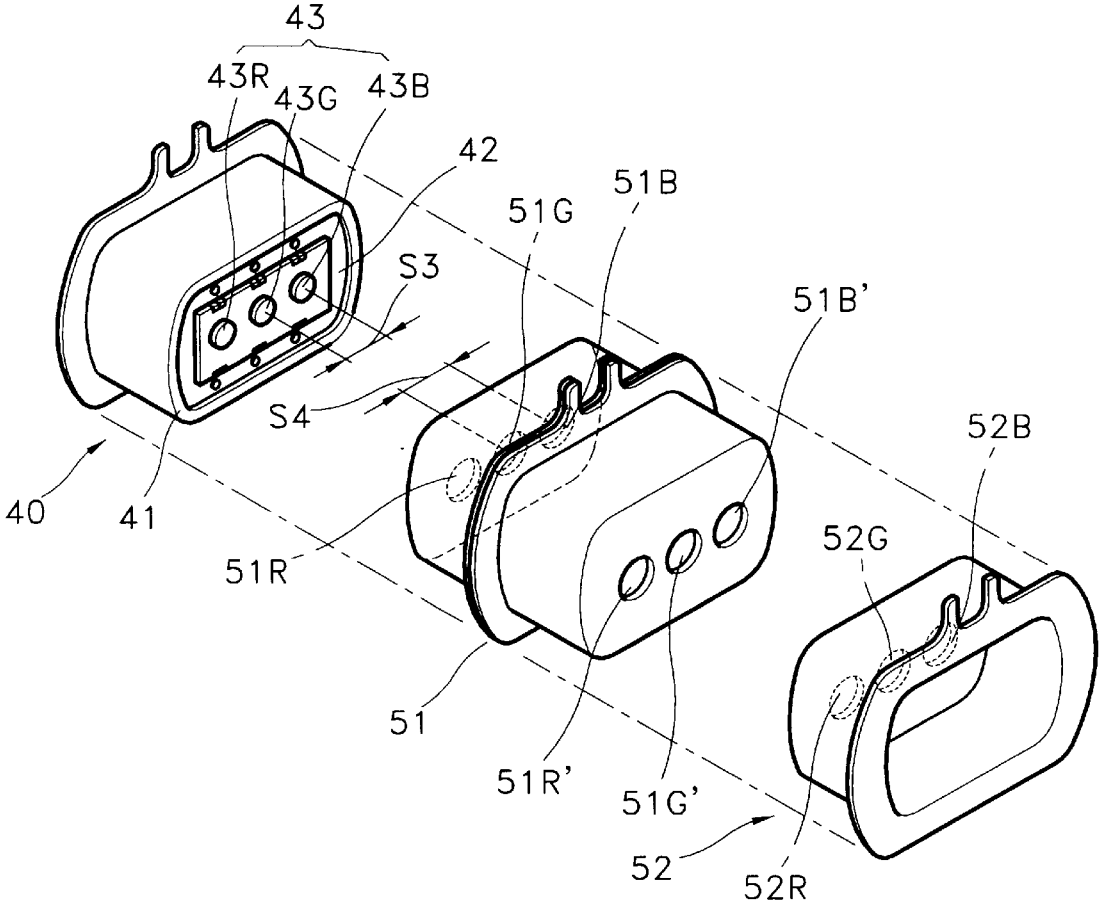
FIG. 3 is a perspective view of an electron gun according to the present invention.

FIG. 3 shows an electron gun for a color cathode ray tube according to a preferred embodiment of the present invention.

The electron gun for a color cathode ray tube includes a cathode structure 40 for emitting electrons, and a focus electrode 51 and a final acceleration electrode 52 for forming a main lens for focusing and accelerating an electron beam emitted from the cathode structure 40.

In the cathode structure 40, a cell 43 having three electron emitting portions 43R, 43G, and 43B formed of a field emission array cell is attached to an insulating member 42 fixed to a rimmed electrode 41.

Figure 4:
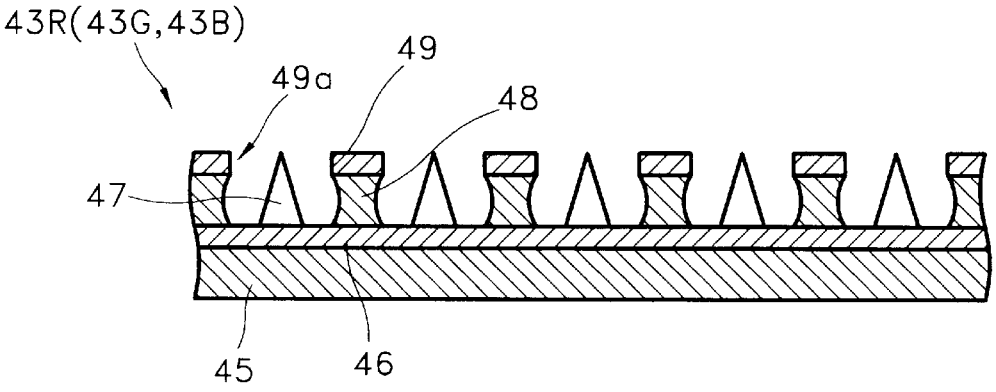
FIG. 4 is a sectional view of a field emission array cell forming an electron emitting portion shown in FIG. 3.

The field emission array cell forming the electron emitting portions 43R, 43G, and 43B, as shown in FIG. 4, includes a base substrate 45 formed of silicon, a conductive layer 46 on the upper surface of the base substrate 45, a plurality of metal tips 47 formed of molybdenum on the upper surface of the conductive layer 46, an insulating layer 48 formed of $SiO_2$ around the metal tips 47, and a metal layer 49 on the upper surface of the insulating layer 48 and having gates 49*a* so as to expose the metal tips 47.

Since a 80–100 nA current is drawn from each metal tip 47 on the base substrate 45, more than 1 mA can be obtained from more than 10,000 metal tips. Therefore, it is possible to secure a current large enough to excite the fluorescent film of the cathode ray tube.

The diameters of the respective electron emitting portions 43R, 43G, and 43B (FIG. 3) are preferably 5/100 to 5/10 of the diameters of the electron beam transmission holes 51R, 51G, and 51B in the incident surface side of the focus electrode 51.

Figure 5:
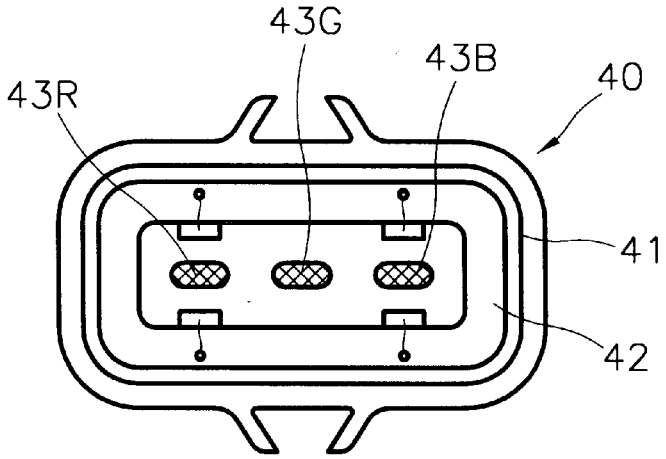
FIGS. 5 and 6 are plan views showing embodiments of a cathode structure according to the present invention.
Figure 6:
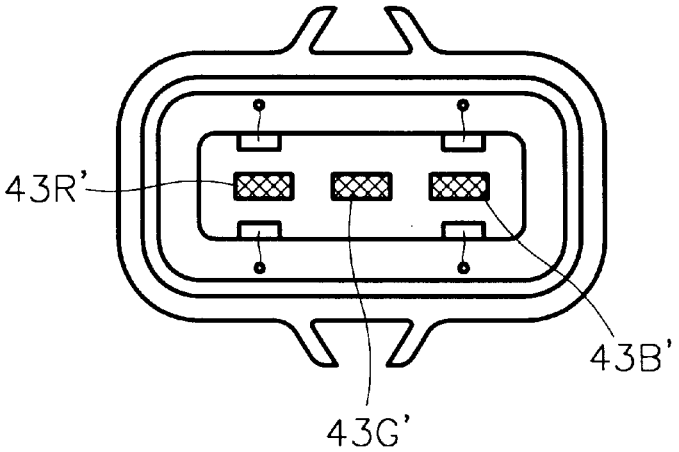

The electron emitting portions 43R, 43G, and 43B formed of the field emission array cell are preferably elongated in the lateral direction, as shown in FIG. 5, in order to compensate for the section of the electron beam landing on the fluorescent film. Also, rectangular electron emitting portions 43R', 43G', and 43B' can be included as shown in FIG. 6.

According to the present invention, as shown in FIG. 3, the eccentric distance S3 between the electron emitting portions 43R, 43G, and 43B is less than the eccentric distance S4 between the electron beam transmitting holes 51R, 51G, and 51B in the incident surface side of the focus electrode 51, in order to improve the convergence characteristics of the electron beam emitted from the electron emitting portions 43R, 43G, and 43B.

Figure 1:
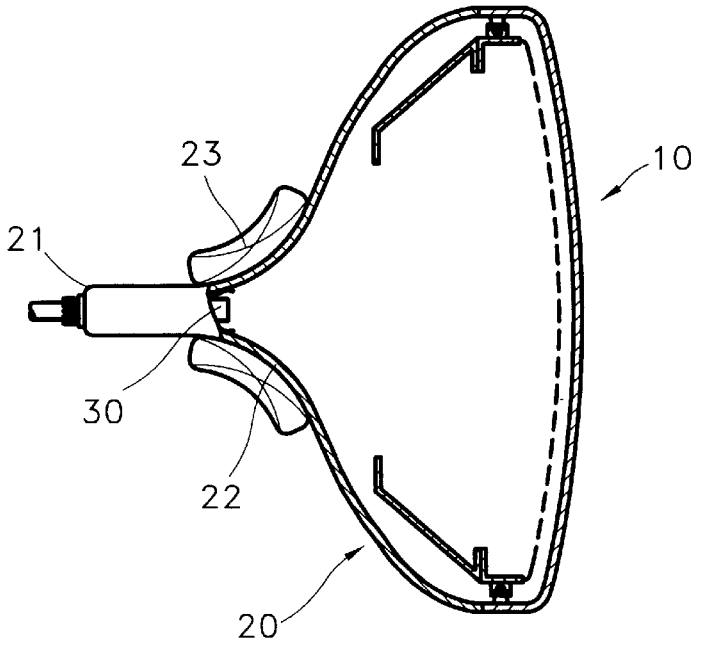
FIG. 1 is a sectional view of a general cathode ray tube.
Figure 2:
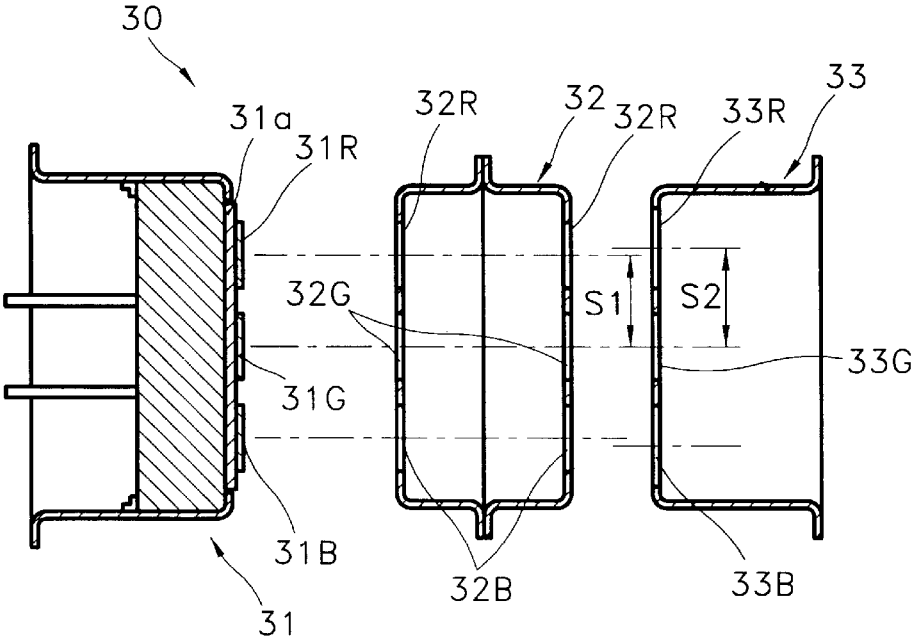
FIG. 2 (PRIOR ART)
FIG. 2 is a sectional view of a conventional electron gun for a color cathode ray tube.
Figure 8:
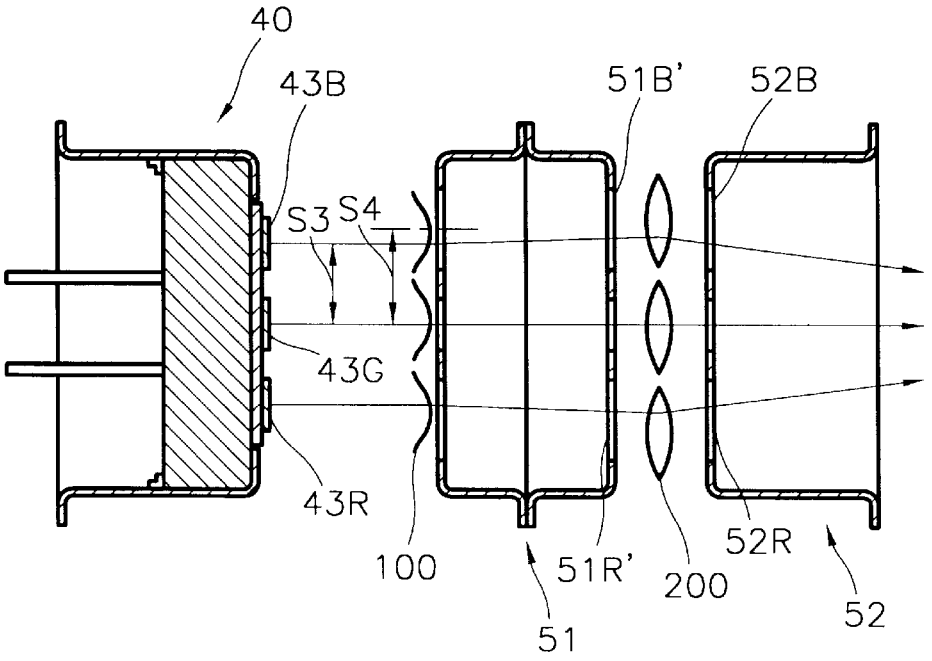
FIG. 8 is a sectional view showing the path of an electron beam through the electron lens of the electron gun shown in FIG. 3.

Referring to FIGS. 3 and 8, in the operation of the electron gun for a color cathode ray tube according to the present embodiment, when a predetermined electrical potential is applied to the focus electrode 51 and the final acceleration electrode 52, an electron lens 100 and a main electron lens 200 are respectively located between the cathode structure 40 and the focus electrode 51 and between the focus electrode 51 and the final acceleration electrode 52. Also, when a predetermined voltage is applied to the metal tips 47 (see FIG. 4) and the metal layer 49 of the cathode structure 40, an electron beam is emitted from the metal tip 47. The emitted electron beam is focused and accelerated, passing through the electron lens 100 and the main electron lens 200, deflected by a deflection yoke 23 (see FIG. 1), and lands on a fluorescent film (not shown), thus exciting a fluorescent material.

At this time, since electrons are emitted from a plurality of tips 47 of the field emission array cell, the current density of the emitted electron beam is uniform and the charge repulsion represented as a square of the current density is also uniform, thus reducing the deterioration of sharpness of the electron beam.

The electron beam emitted from the field emission array cell of the cathode structure 40 is incident in a parallel state before passing through the electron beam transmitting holes 51R, 51G, 51B of the focus electrode 51. However, as the electron beam passes through the electron beam transmitting holes 51R, 51G, and 51B, the beam is refracted by the electron lens 100 and incident on the main electron lens 200 with a large incidence angle.

At this time, since the eccentric distance S4 between the electron beam transmitting holes 51R, 51G, and 51B of the focus electrode 51 is greater than the eccentric distance S3 between the electron emitting portions 43R, 43G, and 43B, the electron beams emitted from the electron emitting portions 43R and 43B are refracted. The electron beam passes through the outer edge of the main electron lens 200 formed between the electron beam transmitting holes 51R' and 51B' of the focus electrode 51 and the electron beam transmitting holes 52R and 52B of the final acceleration electrode 52, thus being affected more by spherical aberration than is the electron beam passing through the center of the main electron lens 200. Therefore, the electron beam converges at both sides toward the center. Accordingly, the convergence characteristics are improved.

The eccentric distance between the electron beam transmitting holes 51R', 51G', and 51B' in the focus electrode 51 of the electron gun according to the present invention and the eccentric distance of the electron beam transmitting holes 52R, 52G, and 52B in the final acceleration electrode 52 can vary, as in a conventional electron gun. The convergence characteristics are improved; however, focus characteristics are deteriorated due to the distortion of the electron beams when the difference between the two eccentric distances is too large. Therefore, the difference between the eccentric distance S3 between the electron emitting portions 43R, 43G, and 43B and the eccentric distance S4 between the electron beam transmitting holes 51R, 51G, and 51B in the incident surface side of the focus electrode 51, and the difference between the accentric distance S4 between the electron beam transmitting holes 51R', 51G', and 51B' in the exit surface side of the focus electrode 51 and the eccentric distance between the electron beam transmitting holes 52R, 52G, and 52B of the final acceleration electrode 52 are appropriately set within a range that improves convergence characteristics without deteriorating focus characteristics.

In the case of an electron gun designed only by the eccentric distance S4 between the electron beam transmitting holes 51R', 51G', and 51'B in the exit surface side of the focus electrode 51 and the eccentric distance S5 between the electron beam transmitting holes 52R, 52G, and 52B of the final acceleration electrode 52, the change of convergence is large since the strength of the electric field between the focus electrode 51 and the final acceleration electrode 52 changes. In the case of the convergence designed by the eccentric distance S3 between the electron emitting portions 43R, 43G, and 43B, the eccentric distance S4 between the electron beam transmitting holes 51R, 51G, and 51B in the incident surface side of the focus electrode 51, the eccentric distance S4 between the electron beam transmitting holes 51R', 51G', and 51'B in the exit surface side of the focus electrode 51, and the eccentric distance S5 between the electron beam transmitting holes 52R, 52G, and 52B of the final acceleration electrode 52, the change of convergence is appropriately set within a small range since the change of the electric field between the electron emitting portion 43 and the incident surface side of the focus electrode 51 is contrary to the change of the electric field between the exit surface side of the focus electrode 51 and the final acceleration electrode 52.

Since the electron emitting portions 43R, 43G, and 43B of the cathode structure 40 are elongated in the lateral direction, the section of the electron beam that passes through the main electron lens 200 is elongated in the lateral direction. Therefore, the distortion of the electron beam passing through the deflection area including a pin cushion magnetic field and a barrel magnetic field, which are non-uniform magnetic fields of the deflection yoke 23, is compensated for during the deflection of the electron beam by the deflection yoke 23. Since the section of the electron beam whose distortion is compensated for is close to being circular, the elongation in the lateral direction and the hazing in the vertical direction of the electron beam landing on the peripheral portion of the fluorescent film are prevented.

The electron beam is emitted from the electron emitting portions 43R, 43G, and 43B with an emitting angle of 20 degrees. The electron beam is significantly affected by the spherical aberration of the main electron lens 200 since the area occupied by the lens 200 becomes larger.

In general, the self focusing that can be performed though the area occupied by the beam is somewhat large in the main electron lens 200 since the focusing force of the main electron lens 200 operates in a direction opposite to the direction in which the deflecting force of the deflection yoke 23 operates. However, along a vertical direction of the screen, the electron beam deflected toward the peripheral portion of the fluorescent film is over-focused since the focusing force of the main electron lens 200 operates in the same direction as the deflecting force of the deflection yoke 23. According to the present invention, it is possible to reduce the area occupied by the beam in the vertical direction on the main electron lens 200 and the deflection areas of the deflection yoke 23 by elongating the section of the emitted electron beam since the electron emitting portions 43R, 43G, and 43B are elongated in the lateral direction. Therefore, since it is possible to reduce the effect of the spherical aberration of the main electron lens 200 and the deflection distortion in the deflection magnetic field with respect to the beam, it is possible to make the section of the electron beam landing on the fluorescent film close to circular.

Figure 7:
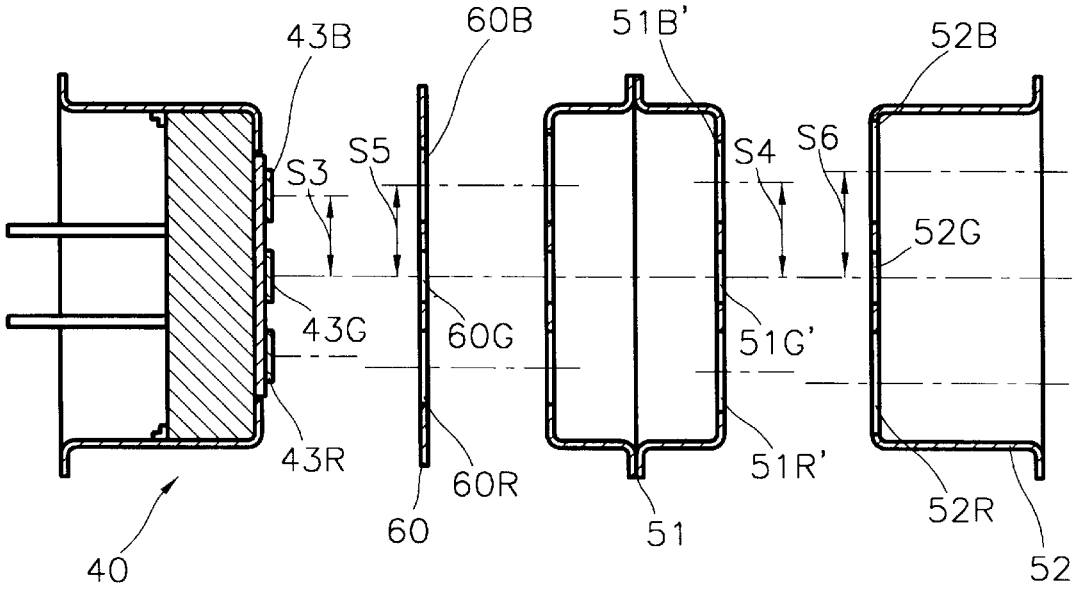
FIG. 7 is a sectional view showing another embodiment of the electron gun according to the present invention.

FIG. 7 shows an electron gun for a color cathode ray tube according to another embodiment of the present invention. Here, reference numerals identical to those of previous drawings denote identical elements.

Referring to FIG. 7, the electron gun of the present embodiment further includes a supplementary electrode 60 installed between the cathode structure 40 and the focus electrode 51 for forming a supplementary electron lens for pre-focusing of the electron beam emitted from the cathode structure 40.

The shape of electron emitting portions 43R, 43G, and 43B formed of the field emission array cell are elongated in the lateral direction as in the above-mentioned embodiments and are preferably rectangular or oval.

Also, the eccentric distance S3 between the electron emitting portions 43R, 43G, and 43B is shorter than the eccentric distance S5 between the electron beam transmitting holes 60R, 60G, and 60B in the supplementary electrode 60. The eccentric distance S4 between the electron beam transmitting holes 51R', 52G', and 51B' in the emitting surface side of the focus electrode 51 is preferably shorter than the eccentric distance S6 between the electron beam transmitting holes 52R, 52G, and 52B in the incident surface side of the final acceleration electrode 52.

Figure 9:
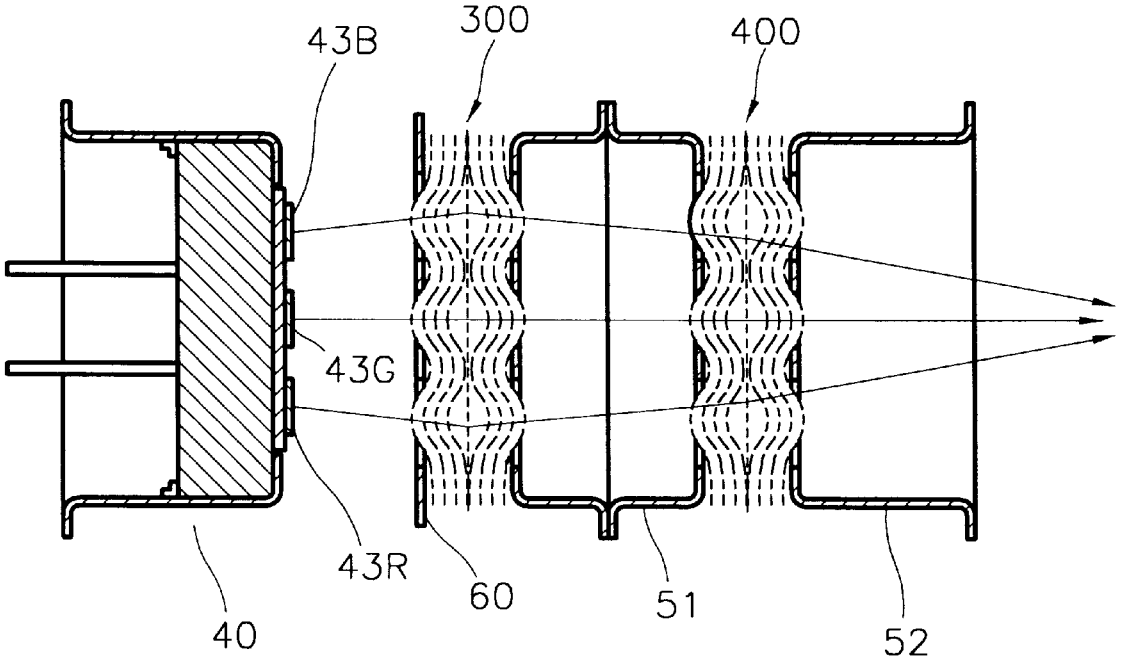
FIG. 9 is a sectional view showing the path of an electron beam through the electron lens of the electron gun shown in FIG. 7.

In the operation of the electron gun for a color cathode ray tube according to the present embodiment, when a predetermined electrical potential is applied to the respective electrodes, a supplementary electron lens 300 is formed between the supplementary electrode 60 and the focus electrode 51 as shown in FIG. 9. Therefore, the electron beam emitted from the electron emitting portions 43R, 43G, and 43B are focused and accelerated, passing through the supplementary electron lens 300, and are incident on the main electron lens 400 and accelerated and focused.

The electron beam emitted from the electron emitting portions 43R, 43G, and 43B with an emitting angle of about 20 degrees is pre-focused by the supplementary electron lens 300, thereby reducing the incident angle of the electron beam incident on the main electron lens 400. Therefore, it is possible to prevent the section of the electron beam from deteriorating due to spherical aberration in the main electron lens 400.

The operation of the electron gun in a state in which the electron emitting portions 43R, 43G, and 43B are elongated in the lateral direction and the eccentric distance S3 between the electron emitting portions 43R, 43G, and 43B is shorter than the eccentric distance S5 of the supplementary electrode 60 is identical to that in the first-described embodiment.

It is possible to prevent distortion of an electron beam due to the deflection yoke in the electron gun for a color cathode ray tube since the electron emitting portion, a field emission array cell, is elongated in the lateral direction. Also, the convergence characteristics are improved by differentiating the eccentric distance between the electron emitting portions from the eccentric distance between the electron beam transmitting holes in the electrodes corresponding to the electron beam emitting portions.

The electron gun for a color cathode ray tube according to the present invention is not restricted to these embodiments and variations are possible within the scope and spirit of the present invention by anyone skilled in the art.

What is claimed is:

1. An electron gun for a color cathode ray tube comprising:

a cathode structure having electron emitting portions including a field emission array cell for emitting electron beams respectively corresponding to red, blue, and green fluorescent materials; and a focus electrode and a final acceleration electrode sequentially arranged with respect to said electron emitting portions for forming a main electron lens for focusing the electron beams emitted from said electron emitting portions and including electron beam transmitting holes, wherein an eccentric distance between said electron emitting portions is shorter than an eccentric distance between the electron beam transmitting holes in said focus electrode.

2. The electron gun for a color cathode ray tube as claimed in claim 1, wherein said electron emitting portions are elongated in a lateral direction.

3. The electron gun for a color cathode ray tube as claimed in claim 2, wherein said electron emitting portions are rectangular.

4. The electron gun for a color cathode ray tube as claimed in claim 2, wherein said electron emitting portions are oval.

5. An electron gun for a color cathode ray tube comprising:

a cathode structure having electron emitting portions including a field emission array cell for emitting electron beams respectively corresponding to red, blue and green fluorescent materials;

a supplementary electrode and a focus electrode for forming a supplementary electron lens for pre-focusing electron beams emitted from said electron emitting portions and including electron beam transmitting holes; and a final acceleration electrode adjacent to said focus electrode for forming a main electron lens with said focus electrodes;

wherein an eccentric distance between said electron emitting portions is shorter than an eccentric distance between the electron beam transmitting holes in the supplementary electrode.

6. The electron gun for a color cathode ray tube as claimed in claim 5, wherein the cross-section of said electron emitting portions is elongated in a lateral direction.

7. The electron gun for a color cathode ray tube as claimed in claim 6, wherein said electron emitting portions are rectangular.

8. The electron gun for a color cathode ray tube as claimed in claim 6, wherein said electron emitting portions are oval.

* * * * *